US005955716A

United States Patent [19]

Thuries et al.

[11] Patent Number: 5,955,716

[45] Date of Patent: Sep. 21, 1999

[54] INTERLOCK CONTROL FOR A CIRCUIT BREAKER AND A DISCONNECTOR

[75] Inventors: Edmond Thuries, Pusignan; Jean-Michel Plat, Estrablin; Jean-Marc Willieme, La Mulatiere, all of France

[73] Assignee: GEC Alsthom T & D, Paris, France

[21] Appl. No.: 09/207,321

[22] Filed: Dec. 7, 1998

[30] Foreign Application Priority Data

Dec. 8, 1997 [FR] France ..... 97 15461

[51] Int. Cl.[6] ..... H01H 3/00; H01H 3/24; H01H 3/32; H01H 33/02

[52] U.S. Cl. ..... 218/154; 218/118; 218/120; 218/140

[58] Field of Search ..... 218/118, 120, 218/140, 154, 1, 4, 7, 9, 48, 50, 74, 78, 84, 92, 107, 108

[56] References Cited

U.S. PATENT DOCUMENTS

| | | | |
|---|---|---|---|
| 3,399,286 | 8/1968 | Kerr . | |
| 3,824,359 | 7/1974 | Date . | |
| 4,591,678 | 5/1986 | Yin . | |
| 4,996,397 | 2/1991 | Kuhn et al. | 218/140 |
| 5,422,450 | 6/1995 | Miyazawa et al. | 218/140 |
| 5,436,414 | 7/1995 | Hodkin et al. | 218/118 |
| 5,438,174 | 8/1995 | Slade | 218/118 |
| 5,898,151 | 4/1999 | Plat et al. | 218/84 |

FOREIGN PATENT DOCUMENTS

| | | |
|---|---|---|
| 0 092 205 A2 | 10/1983 | European Pat. Off. . |
| 787 404 | 9/1995 | France . |
| 2 744 284-A1 | 8/1997 | France . |
| 352870 A1 | 2/1987 | Germany . |

*Primary Examiner*—Lincoln Donovan
*Attorney, Agent, or Firm*—Sughrue, Mion, Zinn, Macpeak & Seas, PLLC

[57] ABSTRACT

The interlock control for a circuit breaker and a disconnector comprises a moving bar for opening or closing the circuit breaker and a displacement rod for displacing a disconnector rod to open or close the disconnector. The moving bar is driven by an arm which is secured to an outlet shaft and which is rotatable in a plane perpendicular to the outlet shaft, and the displacement rod is driven via an L-shaped piece which is movable about an axis that is substantially parallel to the outlet shaft, the arm driving the L-shaped piece during a second opening or closing stage of the circuit breaker via a wheel which is fixed to the arm and which slides in a notch of the L-shaped piece. The outlet shaft makes it possible to achieve interlocking by means of a single control, thereby providing a high level of reliability and of safety.

9 Claims, 2 Drawing Sheets

INTERLOCK CONTROL FOR A CIRCUIT BREAKER AND A DISCONNECTOR

The invention relates to an interlock control for a circuit breaker and a disconnector for opening the disconnector after the circuit breaker has opened, and for closing the circuit breaker after the disconnector has closed.

BACKGROUND OF THE INVENTION

An interlock control of that type is known in particular from French patent application 89 13279. The circuit-breaker comprises two main contacts, of which one is fixed and the other is moving, and two arcing contacts of which one is fixed and the other is moving. Pneumatic valves control displacement of the moving contacts to open or close the circuit-breaker. The disconnector comprises a contact rod which is movable relative to the two fixed contacts, and whose displacement is controlled by another pneumatic valve to disconnect or interconnect the two fixed contacts. The pneumatic valves are provided with electrically-controlled valves that are controlled by sophisticated electronics to ensure that the disconnector opens after the circuit-breaker, and that the circuit-breaker closes after the disconnector.

OBJECT AND SUMMARY OF THE INVENTION

The object of the invention is to make an interlock for a circuit breaker and a disconnector, which is reliable and which is cheap to construct and maintain.

To this end, the invention provides an interlock control for a circuit breaker and a disconnector for opening the disconnector after the circuit breaker has opened, and for closing the circuit breaker after the disconnector has closed, said interlock control comprising a moving bar for opening or closing the circuit breaker and a displacement rod for displacing a disconnector rod to open or close the disconnector, wherein the moving bar is driven by an arm which is secured to an outlet shaft and which is rotatable in a plane perpendicular to the outlet shaft, and the displacement rod is driven via a piece which is movable about an axis that is substantially parallel to the outlet shaft, the arm driving the piece during an opening or closing stage of the circuit breaker via a wheel which is fixed to the arm and which slides in a notch of the piece.

BRIEF DESCRIPTION OF THE DRAWINGS

Other characteristics and advantages of the invention appear on reading the description of two embodiments of the invention shown by the drawings.

MORE DETAILED DESCRIPTION

When the same elements appear in both figures, they are given the same references in each of them.

Figure 1:
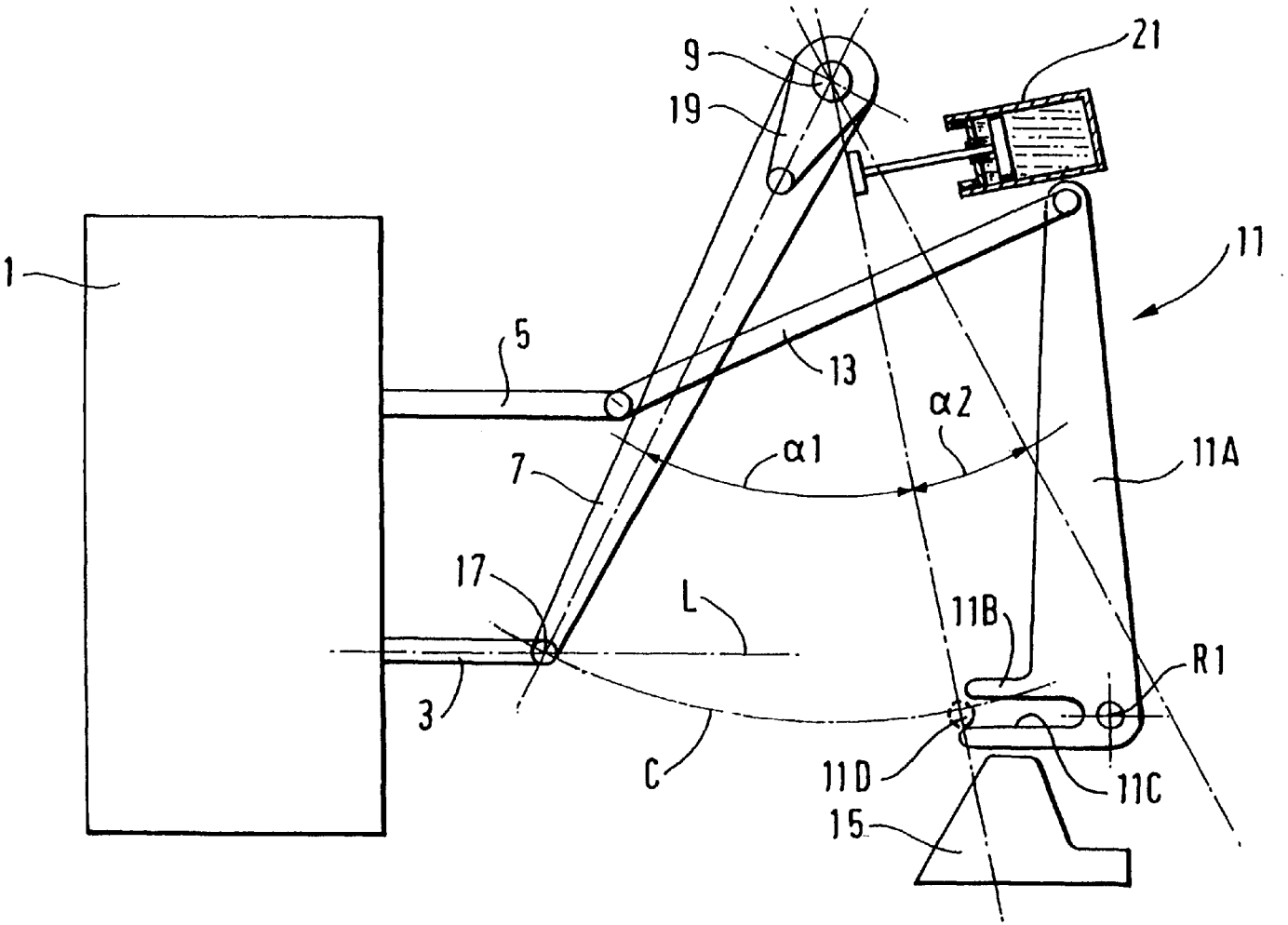
FIG. 1 shows a first embodiment of an interlock control of the invention.
Figure 2:
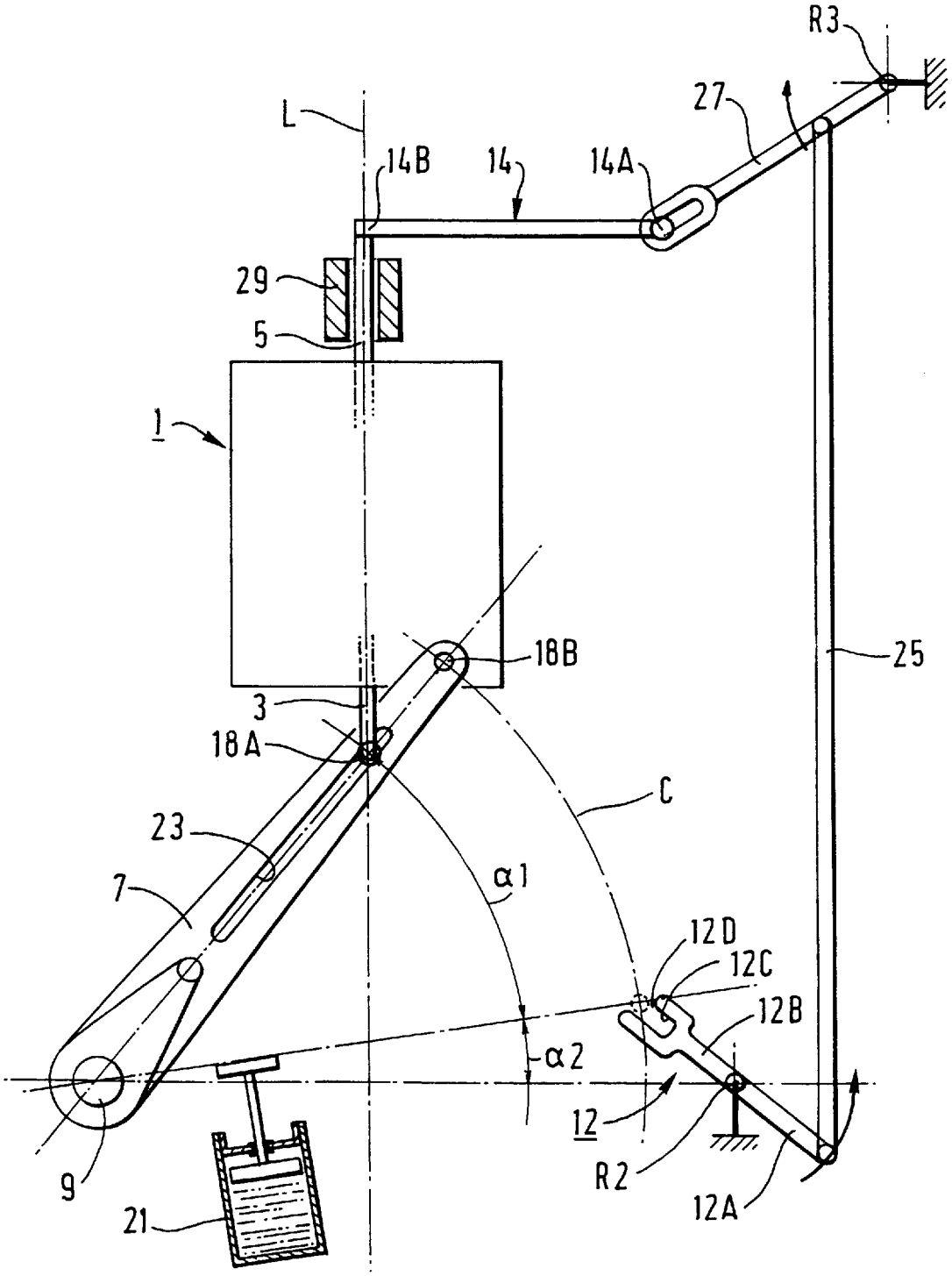
FIG. 2 shows a second embodiment of an interlock control of the invention.

In FIGS. 1 and 2, a circuit breaker and a disconnector are symbolized by a block 1. The circuit breaker is, for example, of the generator circuit-breaker type or of the medium or high voltage network circuit-breaker type. In known manner, it comprises two main contacts, of which one is fixed and the other is moving, and two arcing contacts, of which one is also fixed and the other is moving. The two moving contacts are displaced, for example, in translation along a longitudinal direction L by a bar 3 moving along the longitudinal direction L. By way of example, the disconnector is constituted by a rod which interconnects the two fixed contacts of the circuit-breaker and which slides relative to one of the two contacts to connect or disconnect them. The rod of the disconnector is displaced in translation along the longitudinal direction L by means of a displacement rod 5.

FIG. 1 shows an arm 7 which is secured to an outlet shaft 9 of a mechanical control which is fixed relative to the circuit-breaker, and which is rotatable in the plane perpendicular to the outlet shaft. The moving bar 3 is hinged to the arm 7 so as to be displaced along the longitudinal direction L when the arm 7 is rotated by the outlet shaft 9. The moving bar 3 is preferably hinged to one end of the arm 7 so as to benefit from a large amount of leverage when the outlet shaft 9 is rotated.

An L-shaped piece 11 relative to the circuit-breaker is rotably mounted about a fixed axis R1 that is substantially parallel to the outlet shaft 9 and that passes through the intersection of a long branch 11A and a short branch 11B of the L-shaped piece 11. The displacement rod 5 is connected to move with the long branch 11A via a connecting rod 13 so as to be displaced along the longitudinal direction L when the L-shaped piece 11 is rotated about its axis R1. The connecting rod 13 is preferably hinged to one end of the long branch 11A of the L-shaped piece 11 so as to benefit from a large amount of leverage when said L-shaped piece is rotated about its axis R1.

The short branch 11B of the L-shaped piece 11 has a beak-shaped end with a notch 11C which opens out via an opening 11D. An abutment 15, which is fixed relative to the circuit-breaker, blocks rotation of the L-shaped piece 11 in a position where the short branch 11B is substantially parallel to the longitudinal direction L and which corresponds to a closed position of the circuit-breaker. When the L-shaped piece 11 bears on the abutment 15, the opening 11D of the beak is disposed on a circular path C described by a wheel 17 which is fixed to the arm 7, to receive and guide said wheel 17 in the notch 11C when the arm 7 rotates.

During a first opening stage, the outlet shaft 9 imposes rotation though an angle $\alpha 1$ on the arm 7 during which rotation the moving bar 3 is driven to separate the fixed contacts from the moving contacts of the circuit-breaker. Simultaneously, the wheel 17 describes the circular path C and reaches the opening 11D of the beak-shaped short branch 11B.

During a second opening stage, the outlet shaft 9 imposes rotation through an angle $\alpha 2$ on the arm 7, during which the wheel 17 slides in the notch 11C of the L-shaped piece 11, while rotating said L-shaped piece about its axis R1. By means of the connecting rod 13, the displacement rod 5 is driven by the rotation of the L-shaped piece 11, and displaces the rod of the disconnector to disconnect the two fixed contacts of the circuit-breaker. While the outlet shaft 9 is performing the second opening stage of angle $\alpha 2$, a cam 19 that is mounted on the arm 7 comes into abutment with a shock-absorber 21 that is mounted in a fixed position relative to the circuit-breaker. The speeds of the two opening stages are thus controlled, said speeds typically being 3 meters per second (m/s) during opening of the circuit-breaker, and 0.5 m/s during opening of the disconnector.

At the end of the two rotary stages $\alpha 1$ and $\alpha 2$ of the outlet shaft 9, the circuit-breaker and the disconnector are both open so the electrical assembly offers maximum safety against the risk of short-circuiting.

FIG. 2 shows the arm 7 which is secured to the outlet shaft 9 of a mechanical control which is fixed relative to the circuit-breaker, and which is rotatable in the plane perpendicular to the outlet shaft 9. The moving bar 3 is hinged to the arm 7 so as to be displaced along the longitudinal direction L by means of a first wheel 18A which slides in a recess 23 when the arm 7 is rotated by the outlet shaft 9. The moving bar 3 is hinged to the arm 7 by means of a rod that is made of a non-conductive material so as to insulate the circuit-breaker electrically from the outlet shaft of the mechanical control.

A first lever 12 is rotably mounted about an axis R2 that is fixed relative to the circuit-breaker and that is substantially parallel to the outlet shaft 9. The axis R2 is disposed in approximately the middle of the first lever 12 so as to divide said lever into two branches 12A and 12B. One branch 12B of the first lever 12 is beak-shaped at one end with a notch 12C which opens out via an opening 12D. When the circuit-breaker and the disconnector are closed, as in FIG. 2, the opening 12D of the beak is disposed on a circular path C described by a second wheel 18B which is fixed to the arm 7, to receive and guide said wheel 18B in the notch 11C when the arm 7 rotates. The other branch 12A of the first lever 12 is hinged by means of a rigid rod 25 to a second lever 27 which rotates about an axis R3 that is fixed relative to the circuit-breaker and that is substantially parallel to the outlet shaft 9. The displacement rod 5 is connected to displace the second lever 27 via an insulating connecting rod 14 having one end 14A hinged to the lever 27 and its other end 14B secured to the displacement rod 5 by being disposed perpendicularly to the longitudinal direction L of the circuit-breaker. A sliding member 29 is mounted around the displacement rod 5 to guide its displacement in translation along the longitudinal direction L.

During a first opening stage, the outlet shaft 9 imposes rotation through an angle $\alpha 1$ on the arm 7 during which the moving bar 3 is driven to separate the fixed contacts from the moving contacts of the circuit-breaker. Simultaneously, the second wheel 18B describes the circular path C and reaches the opening 12D of the beak-shaped branch 12B.

During a second opening stage, the outlet shaft 9 imposes rotation through an angle $\alpha 2$ on the arm 7 during which the second wheel 18B slides in the notch 12C of the first lever 12 while rotating said first lever about its axis R2. By means of the rigid rod 25, the second lever 27 is rotated by the first lever 12 in the direction opposite to the direction of rotation of the first lever 12. By means of the insulating rod 14, the displacement rod 5 is driven via the second lever 27 in translation guided by the sliding member 29. The rod of the disconnector is displaced by the displacement rod 5 to disconnect the two fixed contacts of the circuit-breaker. While the outlet shaft 9 is performing the second opening stage of angle $\alpha 2$, a cam 19 that is mounted on the arm 7 comes into abutment with a shock-absorber 21 that is mounted in a fixed position relative to the circuit-breaker. The speeds of the two opening stages are thus controlled.

After both stages of rotation $\alpha 1$ and $\alpha 2$ of the outlet shaft 9, the circuit-breaker and the disconnector are open so that the electrical assembly offers maximum safety with regard to the risk of short-circuiting.

Operation of the single control of the circuit-breaker and the disconnector, whether in FIG. 1 or FIG. 2, is reversible by inverting the direction of rotation of the outlet shaft 9. During the closing stage $-\alpha 2$ of the disconnector, the shock-absorber 21 is not active. The closing speed is imposed by the inertia of the disconnector rod and by the transient conditions of rotation.

In the examples in FIG. 1 and FIG. 2, the outlet shaft 9 is motor-driven to control displacement of the arm 7. It is also proposed for the moving bar 3 to be motor-driven and for the outlet shaft 9 to be de-clutched thereby causing it to act as a mechanical transmitter. The operation described above remains identical.

The single interlock control of the invention applies to circuit-breakers having zero current that is retarded or non retarded.

It is known for an electric arc to form during separation of the arcing contacts, after the main contacts have been separated by a distance that is sufficient to withstand the transient voltage in the dielectric medium of the circuit breaker.

If no electric element delays the zero crossing of the alternating current, the first opening stage $\alpha 1$ is designed to be a duration sufficient for the electric arc to be extinguished by arc-extinguishing means, e.g. by blowing dielectric gas, before the disconnector rod is displaced to separate the fixed contacts of the circuit-breaker. By way of example, the angle of rotation $\alpha 1$ of the outlet shaft is fixed at 52 degrees, for a total rotation $\alpha$ of 60 degrees.

If the zero crossing of the alternating current is retarded, e.g. by a reactive component of an alternator which is mounted in series with the circuit-breaker, then a longer duration is required to extinguish the electric arc formed between the arcing contacts of the circuit-breaker.

In an advantageous embodiment of the invention, the disconnector rod is designed to withstand a transient electric voltage, and to resist the formation of an electric arc. A rod made of a copper and tungsten alloy is preferably chosen. At the end of the first opening stage $\alpha 1$, the electric arc formed between the arcing contacts of the circuit breaker is not extinguished. The displacement of the disconnector rod, generated by the rotation $\alpha 2$ of the outlet shaft, gives rise to an electric arc in series with the arc existing between the arcing contacts. This increase in total electrical resistance, i.e. the sum of the electrical resistance of the two arcs in series, accelerates the zero crossing of the alternating current, and enables the arcs to be extinguished at that moment. The increase in the total electrical resistance is more marked when the medium in which the disconnector is disposed, e.g. atmospheric air, is less dielectric than the medium in which the arcing contacts are disposed, e.g. sulfur hexafluoride $SF_6$ under pressure. The duration required for extinguishing the electric arcs is reduced to a duration that is comparable with that which suffices in the presence of non-retarded electric current by modifying the angles of the first and second opening stages. By way of example, for the outlet shaft having a total angle of rotation $\alpha$ of 60°, the angle of rotation of the first stage is set to be 30° and the angle of rotation of the second stage is set to be 30°, or even 45° and 15° respectively.

We claim:

1. An interlock control for a circuit breaker and a disconnector for opening the disconnector after the circuit breaker has opened, and for closing the circuit breaker after the disconnector has closed, in which a bar is displaced in translation along a longitudinal direction to open or close the circuit breaker, and a rod is displaced in translation along said longitudinal direction to open or close the disconnector, said interlock control comprising:

an arm secured to a rotary shaft and extending in a plane perpendicular to the shaft, the arm being secured to the bar of the circuit breaker so that the bar of the circuit breaker is displaced in translation along said longitudinal direction by rotating the arm;

a piece that is rotably mounted about an axis which is parallel to the rotary shaft, said piece having a beak-shaped first end forming an open notch, and a second end connected to the rod of the disconnector so that said rod is displaced in translation along said longitudinal direction by rotating the piece;

a wheel that is fixed to the arm and that is designed to be engaged in the notch at the end of the piece;

the arm and the piece being disposed relative to each other so that from a closed position of the circuit breaker and the disconnector, a rotation of the arm through a first angle causes the bar of the circuit breaker to be displaced in translation, and simultaneously causes the wheel to move closer to the opening of the notch of the rotary piece, and subsequent rotation of the arm through a second angle causes the piece to rotate about its axis by the sliding action of the wheel in the notch, and simultaneously causes the rod of the disconnector to be displaced in translation.

2. The interlock control according to claim 1, in which a cam is mounted on the arm to come into contact with a shock absorber during the subsequent rotation of the arm.

3. The interlock control according to claim 1, in which said rotary piece is L-shaped and comprises a first branch which is connected to the rod of the disconnector, and a second branch which is shorter than the first branch and which has a beak-shaped end, the axis of rotation of said L-shaped piece being disposed at the intersection of the two branches.

4. The interlock control according to claim 1, in which the rod of the disconnector is connected to the rotary piece via a connecting rod.

5. The interlock control according to claim 1, in which the rotary piece is a lever.

6. The interlock control according to claim 5, in which the rod of the disconnector is secured to an insulating rod which is connected to displace a first branch of the lever via a rigid rod and a second lever, and the notch is formed at one end of a second branch of the beak-shaped lever.

7. The interlock control according to claim 6, in which a sliding member is mounted around the rod of the disconnector.

8. The interlock control according to claim 1, in which the rod of the disconnector is constituted by a material that withstands electric arcs.

9. The interlock control according to claim 8, in which rotation of the arm through the first angle represents 50% to 90% of the total angle of rotation of said arm.

* * * * *